United States Patent [19]

Schwartz

[11] Patent Number: 4,875,312

[45] Date of Patent: Oct. 24, 1989

[54] WALL PANELLING FOR ALTERING THE ACOUSTIC PROPERTIES OF A WALL

[75] Inventor: Karl-Günter Schwartz, Worms, Fed. Rep. of Germany

[73] Assignee: G & H Montage, Ludwigshafen, Fed. Rep. of Germany

[21] Appl. No.: 152,825

[22] Filed: Feb. 5, 1988

[30] Foreign Application Priority Data

Mar. 4, 1987 [DE] Fed. Rep. of Germany ..... 3706984

[51] Int. Cl.[4] ..... E04B 1/82

[52] U.S. Cl. ..... 52/144; 52/484; 181/287; 49/388

[58] Field of Search ..... 52/144, 145, 484; 181/30, 287, 293; 49/388, 390, 392

[56] References Cited

U.S. PATENT DOCUMENTS

| | | | |
|---|---|---|---|
| 1,703,944 | 3/1929 | Matchette | 181/287 X |
| 1,896,844 | 2/1933 | Hanson | 181/30 |
| 3,007,539 | 11/1961 | Brewer et al. | 52/144 |
| 3,382,947 | 5/1968 | Biggs | 181/30 |
| 3,676,955 | 7/1972 | Schacht | 49/390 X |
| 4,098,026 | 7/1978 | Strzepek | 49/390 |

FOREIGN PATENT DOCUMENTS

| | | | |
|---|---|---|---|
| 8531 | 7/1928 | Australia | 181/287 |
| 256407 | 12/1966 | Austria | 49/390 |
| 897320 | 7/1949 | Fed. Rep. of Germany | 181/287 |
| 2724717 | 12/1978 | Fed. Rep. of Germany | 181/30 |

*Primary Examiner*—David A. Scherbel
*Assistant Examiner*—Anthony W. Williams
*Attorney, Agent, or Firm*—Finnegan, Henderson, Farabow, Garrett & Dunner

[57] ABSTRACT

A wall panelling for altering the acoustic properties of a wall, comprising wall elements adapted to have their orientation altered with respect to the wall. The wall panelling comprises a plurality of hinged frames mounted on the wall panelling or the wall itself and adapted to be swung away from the wall panelling or wall, respectively. The frames contain wall elements mounted therein for rotation by 180° with respect to the associated frame. The front and rear faces of the wall elements have different acoustic absorption or reflection properties.

6 Claims, 2 Drawing Sheets

WALL PANELLING FOR ALTERING THE ACOUSTIC PROPERTIES OF A WALL

BACKGROUND OF THE INVENTION

1. Field of the Invention

The present invention relates to a wall panelling for altering the acoustic properties of a wall, comprising wall elements adapted to have their orientation altered with respect to a wall.

2. Description of the Prior Art

Wall panellings adapted to have their acoustic properties altered are used for altering the acoustic conditions in enclosures employed for different purposes. If for instance the acoustic properties of a room are to be adapted to optimum speech intelligibility, the desired properties include short reverberation and pronounced absorption. Adaptation of the acoustics of a room to musical performances on the other hand requires properties including long reverberation and an increased volume of lateral reflection. In the case of multi-purpose rooms, recording studios and the like, the demands as to acoustic properties may vary within a wide range. Rooms of this type are therefore suitably equipped with wall and/or ceiling elements having variable acoustic properties. These elements may be mounted in such a manner that they can be shifted, rotated or the like to different positions to present surfaces having different acoustic properties facing into the respective room. The wall and/or ceiling elements thus employed, referred to in the following as "wall elements" for brevity, are preferably of a type having reflecting and absorbing surfaces adapted to be selectively brought to an operative position.

Structural elements hitherto preferably employed for the purpose outlined above were of a three-dimensional type in the form for instance of cylindrical or triangular columns mounted for rotation about a fixed axis. A panelling of this type suffers from the serious disadvantage that its installation requires a considerable depth of about 50 cm or even more, and that the maneuverability and adjustability of the wall elements is impaired by their considerable volume. As a whole, the hitherto known wall panellings of this type lead to a twofold cost increase in that the enclosed volume of a room has to be increased for achieving a predetermined open room volume, and in that the manufacturing costs for such bulky, heavy wall elements and their rotatable mounting are quite onerous.

SUMMARY OF THE INVENTION

It is an object of the present invention to provide a wall panelling having a reduced installation depth and being capable of being readily adapted to different demands with regard to acoustic properties.

Proceeding from a wall panelling as defined in the introduction, the above object is attained according to the invention by said wall panelling comprising frames disposed within the wall panelling and adapted to be pivoted out of the panelling, the wall elements being substantially plate-shaped and mounted each in one of said frames for rotation about a predetermined axis, the front and rear faces of said wall elements having different acoustic absorption and reflection properties. As a result of this construction, the wall panelling by itself may have a very small installation depth or thickness, and may practically mounted directly on the wall of a building. This permits the enclosed space required for an open room space of a given size to be noticeably reduced. Irrespective thereof, the individual wall elements can be readily rotated by 180° after their respective frames have been swung away from the wall, to thereby interchange their front and back faces for obtaining different acoustic properties of the enclosed space.

The term "wall" as used in the description is not intended to refer only to a vertical wall, but also to walls extending in different planes, and particularly also to horizontally extending walls such as ceilings and floors.

BRIEF DESCRIPTION OF THE DRAWINGS

A preferred embodiment of the invention shall now be described by way of example with reference to the accompanying drawings, wherein.

DESCRIPTION OF THE PREFERRED EMBODIMENT

Figure 1:
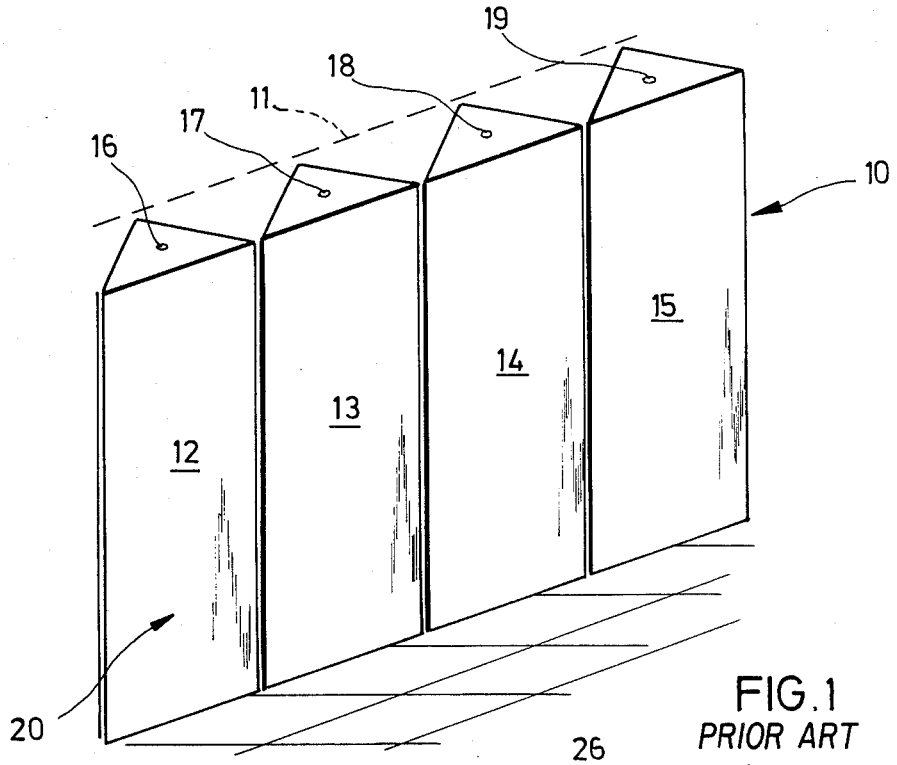
FIG. 1 PRIOR ART
FIG. 1 shows a diagrammatic illustration of a prior art wall panelling.

Diagrammatically shown in FIG. 1 is a known wall panelling 10 comprising a plurality of columnar wall elements 12 to 15 mounted at spaced locations in front of a building wall 11 indicated by a phantom line. The horizontal cross-section of wall elements 12 to 15 has the shape of a equilateral triangle. Elements 12 to 15 are mounted for rotation about vertical axes 16 to 19. Wall elements 12 to 15 may thus be rotated to present different ones of their faces to the room at the side facing away from wall 11. The great volume of each wall element 12 to 15 requires a considerable distance to be maintained between building wall 11 and the inner wall surface 20 composed of selectively determined faces of the wall elements.

Figure 2:
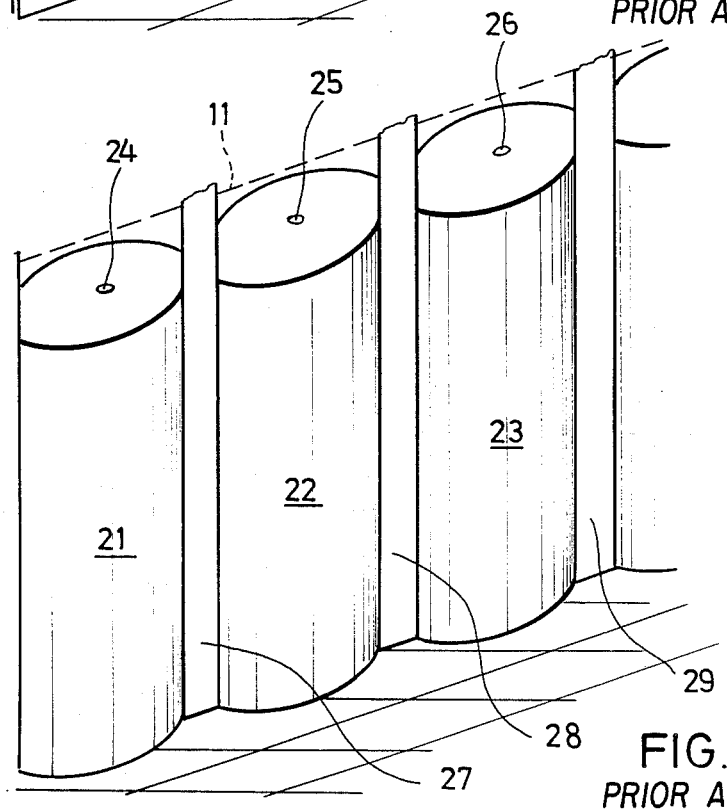
FIG. 2 PRIOR ART
FIG. 2 shows a diagrammatic illustration of another embodiment of a prior art wall panelling.

FIG. 2 represents another known embodiment comprising a plurality of wall elements in the form of circular cylinders 21 to 23 mounted for rotation about vertical axes 24 to 26. Disposed between adjacent cylinders are vertically extending cover plates 27 to 29. The maneuverability of the cylinders is considerably impaired by their great volume.

Figure 3:
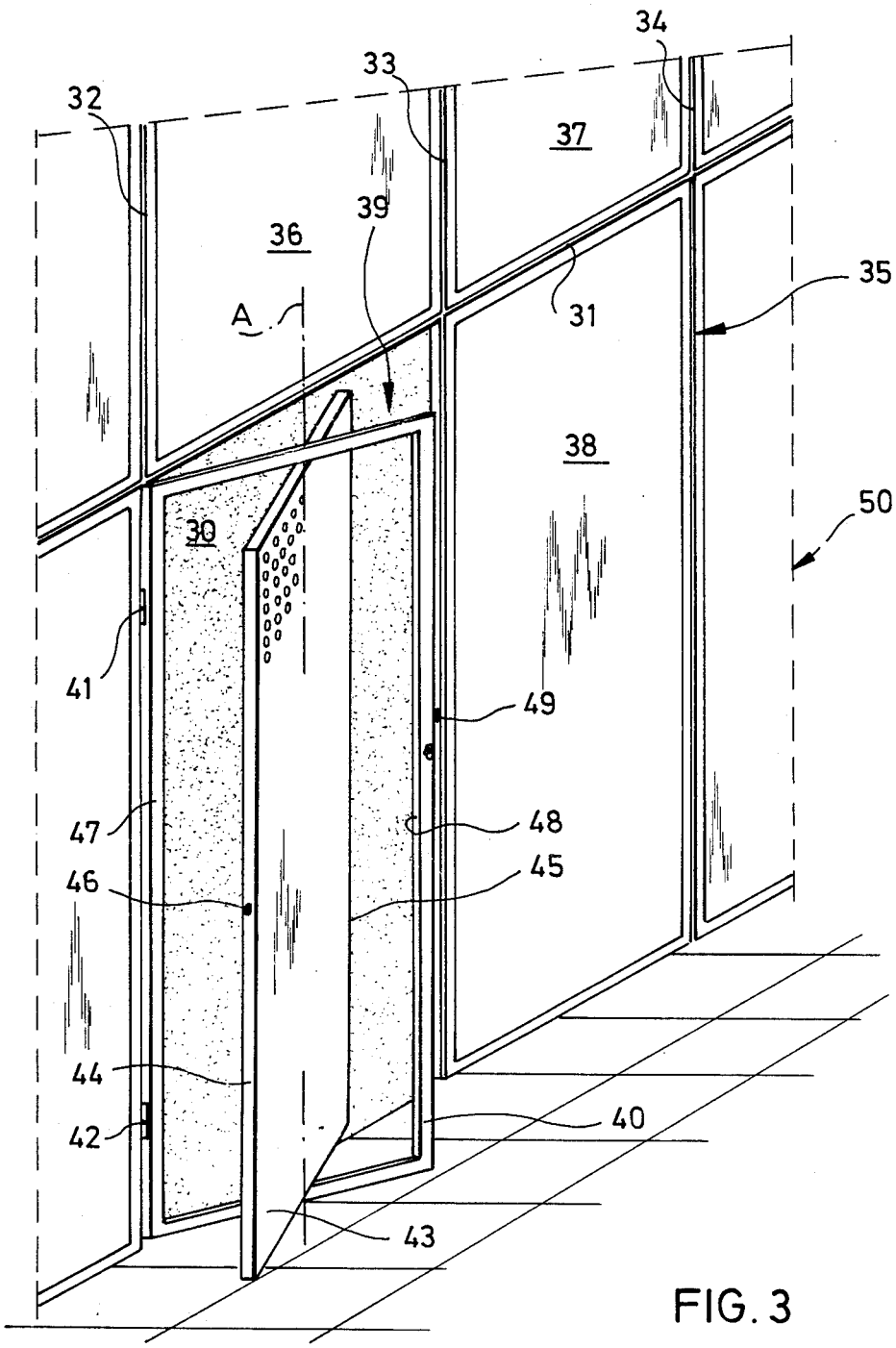
FIG. 3 shows a perspective view of a preferred embodiment of a wall panelling according to the invention.

In the embodiment of a wall panelling according to the invention as shown in FIG. 3, a framework 35 composed of vertical and horizontal struts 31 to 34 is erected in front of a building wall 30. Framework 35 may be positioned a short distance in front of building wall 30 or secured directly thereto. The struts 31 to 34 divide framework 35 into a plurality of fields indicated for instance at 36, 37, 38 and 39. Each field is surrounded by a frame, the figure showing only the one frame 40 associated to field 39. In the illustrated embodiment each frame is hinged to framework 35 along its vertical left boundary by means of hinges 41, 42. Frame 40 is thus pivotable about a vertical axis extending in or in front of vertical strut 32. The frame or frames, respectively, may be made of wood, plastic or metal and may consist of the same material as framework 35 or a different material. The framework may also be omitted, in which case the frames are hinged directly on the building wall.

Mounted in frame 40 for rotation about a vertical symmetry axis A is a wall element 43. Axis A is symmetric with respect to both frame 40 and the vertical symmetry axis of wall element 43. Wall element 43 is preferably configured in the shape of a plate. The surfaces of wall element 43 may be structured in any suitable manner, the front and back faces of wall element 43 being preferably covered with different materials in order to obtain different acoustic absorption and reflection properties of the wall element. Irrespective of the different acoustic properties of the front and back face of the wall element, the respective acoustically active cover materials may be selected to have the same visual appearance, if the wall panelling is to have variable acoustic properties with an unalterable visual appearance.

At its opposite lateral edges 44, 45, wall element 43 is provided with detent elements only one of which is shown at 46. Detent element 46 is adapted to cooperate with corresponding recesses at the inner side of the vertical frame members 47 and 48, respectively, these recesses being not shown in detail. In the same manner frame 40 may be provided with detent means cooperating with vertical strut 33 of framework 35. This detent means 49 may consist of a spring-biased detent ball adapted to engage a complementary recess. It is of course also possible to provide conventional locking devices such as locking bolts or the like in place of the described detent devices.

When the acoustic conditions of the room are adjusted to desired absorption or reflection properties, the wall elements extend preferably in the plane of the wall panelling 50. More specifically, each wall element lies in the plane of its associated frame, and the fame itself lies in the plane of framework 35. The acoustic properties of the room may be altered in a simple manner by swinging each or any frame 40 out of the plane of framework 35 about its vertical axis as defined by hinges 41, 42, as shown in FIG. 3 with respect to frame 40. In this position of the frame, the wall element 43 may be rotated by 180° about its vertical axis to present its former back face to the room. After this rotation by 180° wall element 43 is arrested in position by its detent elements or other locking means, whereupon frame 40 is swung back to its original position in the plane of framework 35. This procedure may be repeated at each field 36 to 39. The final result of this operation is a wall panelling presenting acoustic properties different from those in the previous state.

As described above, the wall elements are preferably used in positions in which they lie in the plane of framework 35. Also imaginable, however, are applications in which the building wall proper is provided with a particular sound-absorbent or sound reflective coating which can be brought to full effect by swinging all frames with their wall elements by an angle of 90° out of the plane of the framework. Further positions are also imaginable, in which the frames are swung out of the plane of the framework by an angle of less than 90°, and the wall elements are rotated in their frames by any suitable angle. This angle may be the same or a different one for each wall element. The wall panelling according to the invention is thus highly variable and may be readily adapted to any desired acoustic properties of a room.

In the embodiment shown in FIG. 3, wall element 43 is rotatable in frame 40 only about a fixed vertical axis. The wall element may also, however, be mounted for rotation about a horizontal axis. It may also be considered to provide the axis of rotation along one lateral edge of the wall element, with a pair of pins projecting from opposite ends in alignment with the axis and guided in grooves formed in opposite frame members for sliding displacement therein.

I claim:

1. A wall panelling for altering the acoustic properties of a wall, comprising said wall panelling being mounted adjacent said wall, a plurality of frames disposed within said wall panelling and adapted to be pivoted relative to said wall panelling about an axis extending along one edge thereof to swing an opposite edge thereof away from said wall, wall elements being substantially plate-shaped and mounted each in one said frame for rotation of at least 180 degrees relative to and independent of rotation of said frame about a predetermined axis, and each said wall element having front and rear faces with different acoustic absorption and reflection properties on said front and rear faces.

2. A wall panelling according to claim 1, characterized in that said frames are pivotable about a respective axis extending in a plane of said wall panelling.

3. A wall panelling according to claim 1 or 2, characterized in that said frames are lockable at predetermined positions, including a position in a plane of said wall panelling.

4. A wall panelling according to claim 3, characterized in that each of said wall elements is mounted in a respective frame for rotation about a longitudinal or transverse axis of symmetry.

5. A wall panelling according to claim 3, characterized in that each of said wall elements is mounted for rotation about a longitudinal or transverse disposed at a fixed position with respect to each wall element and displaceable in the plane of the respective frame.

6. A wall panelling according to claim 5, characterized in that each of said wall elements are lockable at least at a position in the plane of the respective frame.

* * * * *